US009212021B2

(12) United States Patent
Rhodes et al.

(10) Patent No.: US 9,212,021 B2
(45) Date of Patent: Dec. 15, 2015

(54) WINDING CORES FOR MATERIAL ROLLS HAVING HIGH ROLL STRAIN ENERGY, AND METHOD FOR MAKING SAME

(75) Inventors: David E. Rhodes, Hartsville, SC (US); John F. Auten, Hartsville, CA (US); Yiming Wang, Middleton, WI (US); Wim Van de Camp, Hartsville, SC (US); Terry Gerhardt, Hartsville, SC (US); Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 1426 days.

(21) Appl. No.: 12/025,441

(22) Filed: Feb. 4, 2008

(65) Prior Publication Data

US 2009/0194625 A1 Aug. 6, 2009

(51) Int. Cl.
*B65H 75/18* (2006.01)
*B65H 75/10* (2006.01)

(52) U.S. Cl.
CPC ..... *B65H 75/10* (2013.01); *B65H 2701/31* (2013.01); *B65H 2701/5112* (2013.01)

(58) Field of Classification Search
USPC ..... 242/118.8, 160.1, 610, 610.1, 610.4, 242/610.6
See application file for complete search history.

(56) References Cited

U.S. PATENT DOCUMENTS

| | | | | |
|---|---|---|---|---|
| 2,350,369 | A | | 6/1944 | Sampair et al. |
| 2,394,639 | A | | 2/1946 | Seem |
| 2,659,543 | A | | 11/1953 | Guyer |
| 3,632,053 | A | | 1/1972 | Edwards et al. |
| 4,025,675 | A | * | 5/1977 | Jonda ..... 428/36.2 |
| 4,238,540 | A | * | 12/1980 | Yates et al. ..... 428/35.9 |
| 4,442,686 | A | | 4/1984 | Beffart et al. |
| 4,923,137 | A | | 5/1990 | Jorgensen et al. |
| 5,415,357 | A | * | 5/1995 | Smith, Jr. ..... 242/160.1 |
| 5,505,395 | A | | 4/1996 | Qiu et al. |
| 5,873,543 | A | | 2/1999 | Schneider et al. |
| 6,102,326 | A | | 8/2000 | Liepold et al. |
| 6,405,974 | B1 | | 6/2002 | Herrington |
| 6,586,110 | B1 | | 7/2003 | Obeshaw |

(Continued)

FOREIGN PATENT DOCUMENTS

| | | |
|---|---|---|
| CH | 549 523 A | 5/1974 |
| EP | 1 419 985 A2 | 5/2004 |
| WO | WO 93/16947 | 9/1993 |

OTHER PUBLICATIONS

International Search Report and Written Opinion of the International Searching Authority for International Application No. PCT/US2009/030892; dated Apr. 15, 2009.

*Primary Examiner* — William A Rivera
(74) *Attorney, Agent, or Firm* — Alston & Bird LLP

(57) ABSTRACT

Winding cores for elastically stretched or shrinkable materials are designed to significantly reduce the amount of roll strain energy developed during winding. This is accomplished by building into the core an energy-absorbing zone that can be collapsed by a substantial amount and in a relatively controlled fashion over a substantial period of time under the influence of a continued radially inward pressure exerted by the roll of wound material. The energy-absorbing zone is formed by one or more collapsible layers having repeated atomic regions projecting out of a plane of the sheet and each defining a plurality of normal vectors in different sub-regions of the atomic region, wherein the normal vectors, when projected onto the two-dimensional plane of the sheet, are in a plurality of different directions in the plane.

14 Claims, 10 Drawing Sheets

(56) References Cited

U.S. PATENT DOCUMENTS

| | | | |
|---|---|---|---|
| 6,821,638 | B2 | 11/2004 | Obeshaw |
| 6,851,643 | B2 | 2/2005 | Qiu et al. |
| 6,893,733 | B2 | 5/2005 | Obeshaw |
| 6,955,780 | B2 | 10/2005 | Herrington |
| 2002/0006523 | A1 | 1/2002 | Obeshaw |
| 2004/0096604 | A1 | 5/2004 | van de Camp |
| 2005/0113235 | A1 | 5/2005 | Basily et al. |
| 2006/0043234 | A1 | 3/2006 | Chen |

* cited by examiner

WINDING CORES FOR MATERIAL ROLLS HAVING HIGH ROLL STRAIN ENERGY, AND METHOD FOR MAKING SAME

BACKGROUND OF THE INVENTION

The present disclosure is related to winding cores, and more particularly is related to winding cores for materials including but not limited to plastic non-shrink film, plastic shrink film, yarns, and other elastic materials that are wound under tension such that the material is in an elastically stretched condition when wound about the core and/or shrinks after being wound about the core, resulting in substantial and continuing radially inward pressure on the core.

In the winding of such materials, the roll of wound material stores energy referred to herein as "roll strain energy" because of the tension under which the film is wound around the core and/or because of the shrinkage of the material after winding. This mechanism is analogous to a spring which, when deformed, stores energy. Conversely, when the deformation in the spring is relieved, the stored energy in the spring is reduced. Wound roll structures having high roll strain energy significantly compress the core OD, causing a reduction in the inside diameter of the core, referred to herein as "ID comedown". Additionally, the compressive load from the roll also causes the core to grow in length. These effects can lead to problems in the field.

BRIEF SUMMARY OF THE DISCLOSURE

It has been discovered that some wound materials, such as some plastic films, can continue to exert radially inward pressure on the core for a prolonged period of time after winding is completed, and the pressure in some cases can even increase over time after winding, leading to a greater and greater amount of ID comedown. Excessive ID comedown causes failures in the field.

While winding cores have been devised that include a region in the core wall that is designed to be radially compressed relatively easily so as to help immediately relieve some of the radially inward compression exerted by the material during winding, existing winding cores of this type known to the applicant are deficient in one or more respects. First, in some such winding cores, the radially compressible region collapses too abruptly and in a substantially uncontrolled fashion, immediately or soon after winding begins. For example, it is known to include one or more conventional corrugated paperboard layers in a winding core, such as described in Swiss patent document CH 549 523 published on May 31, 1974, or U.S. Pat. No. 2,350,369 issued on Jun. 6, 1944. The applicant has found that conventional corrugated paperboard layers of this type can collapse almost immediately when winding begins, which can lead to high vibration of the rapidly rotating core. Applicant has discovered that what is needed is a winding core having a collapsible structure that collapses less abruptly and in a more-controlled fashion. However, the winding core prior art known to the applicant does not teach how to achieve this objective, and indeed does not even teach that the objective is desirable.

Second, in other such winding cores, the radially compressible region does not have a sufficient capacity for relieving roll strain energy to significantly reduce the ID comedown problem; in other words, the prior-art structures provide too small a radial thickness reduction to be effective. For example, U.S. Pat. No. 5,505,395 issued on Apr. 9, 1996, describes a multi-grade winding core having a wall structure of the type "strong/weak/strong", wherein there are one or more plies of relatively weaker paperboard disposed in the interior of the core wall between inner and outer plies of relatively stronger paperboard. The weaker paperboard has greater compliance or compressibility and thus helps to absorb some of the inward pressure from the wound material, thereby tending to reduce ID comedown. However, a winding core of this type does not have sufficient capacity to absorb the large pressure exerted by plastic films wound under significant tension. This is especially true in view of the present-day practice of winding larger and heavier rolls under higher tensions, in comparison with winding practices that were common one or more decades ago. Thus, even if prior winding cores may have been adequate for the less-demanding winding environments in the past, such cores in general are not able to function acceptably in today's demanding winding environments. Applicant has discovered that what is needed is a winding core having a radially compressible structure providing a substantial degree of radial thickness reduction, while at the same time being compressible less abruptly and in a more-controlled fashion than prior-art structures. However, the winding core prior art known to the applicant does not teach how to achieve this objective, and indeed does not even teach that the objective is desirable.

These objectives are achieved at least to a substantial degree by the winding cores in accordance with the present disclosure, wherein the cores are designed to significantly reduce the amount of roll strain energy developed during winding. This is accomplished by building into the core an "energy-absorbing zone" that can be collapsed by a substantial amount and in a relatively controlled fashion over a substantial period of time under the influence of a continued radially inward pressure exerted by the roll of wound material. These design innovations lead to better efficiency, as they reduce the required radial crush strength of the core. Such core designs are expected to improve product sustainability by reducing the volume of material required, and to survive in applications too demanding for current core designs.

In accordance with one aspect of the disclosure, there is described a winding core for winding a continuous web of elastically stretchable or shrinkable material to form a roll of the material, wherein the roll has a roll strain energy resulting in a radially inward pressure on the core. The winding core comprises a cylindrical structure formed of a plurality of layers wound one upon another about an axis and adhered together, wherein the core comprises a radially inner shell formed by a plurality of inner layers each having opposite substantially smooth and non-undulating surfaces, a radially outer shell formed by one or more outer layers each having opposite substantially smooth and non-undulating surfaces, and an energy-absorbing zone disposed radially between the inner and outer shells. The energy-absorbing zone comprises at least one collapsible layer formed from a sheet that is structured such that each of the opposite surfaces of the sheet defines a three-dimensional structured atomic region that is repeated throughout the surface, the atomic region projecting out of a plane of the sheet and defining a plurality of normal vectors in different sub-regions of the atomic region. The normal vectors, when projected onto the two-dimensional plane of the sheet, are in a plurality of different (i.e., non-collinear) directions in said plane.

The projections of the repeated atomic regions to the two-dimensional plane of the sheet forms a tiling of the plane.

The atomic regions of the energy-absorbing zone are structured such that the energy-absorbing zone is collapsible by a total amount $\Delta R$ when radially compressed by a radially inward pressure $P_c$. The core is structured such that ID comedown of the inner shell is less than a predetermined value as long as the energy-absorbing zone is in the process of collapsing, and the energy-absorbing zone is structured such that collapsing of the energy-absorbing zone begins during or after winding of the web to form the roll. Preferably, the energy-absorbing zone still has additional collapsibility at the moment when winding of the roll is just completed, such additional collapsibility being sufficient to substantially absorb continued radially inward pressure exerted by the roll after completion of winding.

A winding core as described above has distinct advantages over conventional winding cores that are constructed entirely of non-undulating or "flat" layers. To keep the ID comedown of such a conventional winding core less than a predetermined value, the conventional approach has been simply to increase the radial crush strength of the core by increasing the wall thickness and/or using stronger material. The approach in accordance with the present disclosure, in contrast, is to build an inner shell of the core only as strong as necessary to withstand the amount of pressure transferred to it via the energy-absorbing zone (plus a safety margin). The energy-absorbing zone is specifically configured to begin collapsing at a pressure exerted by the wound material either during or after winding. However, unlike prior-art winding cores such as described in CH 549 523 and U.S. Pat. No. 2,350,369, which are prone to collapsing almost immediately after winding begins, the energy-absorbing zone of the present cores, at least in some embodiments, still retains additional collapsibility after winding is completed. This is due in large part to the particular structure of the collapsible layer(s) with the atomic regions.

In one embodiment, the inner shell of the core comprises at least three inner layers, or at least four inner layers, or at least five inner layers, or at least six inner layers, or at least seven inner layers, or at least eight inner layers.

In one embodiment, the inner layers have calipers ranging from about 0.013 inch to about 0.045 inch. In accordance with one embodiment, when the inside diameter of the core is about 1 inch to about 24 inches, the total radial thickness of the inner shell ranges from about 0.100 inch to about 1.0 inch.

In accordance with one embodiment, the energy-absorbing zone comprises at least two collapsible layers. The at least two collapsible layers can be contiguous with each other.

In one embodiment, the atomic regions of each collapsible layer are formed by folded tessellations in the sheet.

Alternatively, in another embodiment, the atomic regions of each collapsible layer are formed as discrete raised areas of the sheet. For example, each such atomic region can be formed as a truncated cone or pyramid and can have an uppermost surface that is substantially planar and has a substantial surface area, e.g., at least about 0.05 $in^2$ (about 32 $mm^2$), or at least about 0.1 $in^2$ (about 64 $mm^2$). In preferred embodiments, both of the opposite surfaces of the collapsible layer have such substantially planar uppermost surfaces of the atomic regions. These substantially planar surfaces provide good adhesion of the collapsible layer to adjacent layers of the core. Alternatively, the discrete raised areas can have a part-spherical or dome shape having a generally continuous curvature over its entire surface.

In a further embodiment, the atomic regions of at least one collapsible layer comprise a grid pattern formed by first generally linear raised regions extending in a first direction and intersecting second generally linear raised regions extending in a second direction different from the first direction.

The atomic regions of the collapsible layer differ from conventional corrugations in a number of respects. First, corrugations are formed by folding the paper such that the paper is deformed in a manner that does not substantially disrupt fiber-to-fiber bonds in the paper. In the case of a collapsible layer formed of paperboard in accordance with some embodiments of the invention, the atomic regions are formed by structuring the paperboard in a manner that results in substantial disruption of fiber-to-fiber bonds (and in some cases results in partial tears in the sheet). Second, the normal vectors to the flutes of conventional corrugated board, when projected onto the two-dimensional plane of the sheet, lie in only one direction (or, more accurately, in two opposite collinear directions), perpendicular to the length direction of the flutes. In contrast, the atomic regions of the collapsible layers of the present invention have normal vectors that lie in multiple different (non-collinear) directions when projected onto the plane of the sheet. This greatly enhances the energy-absorbing capacity of the collapsible layer.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1:
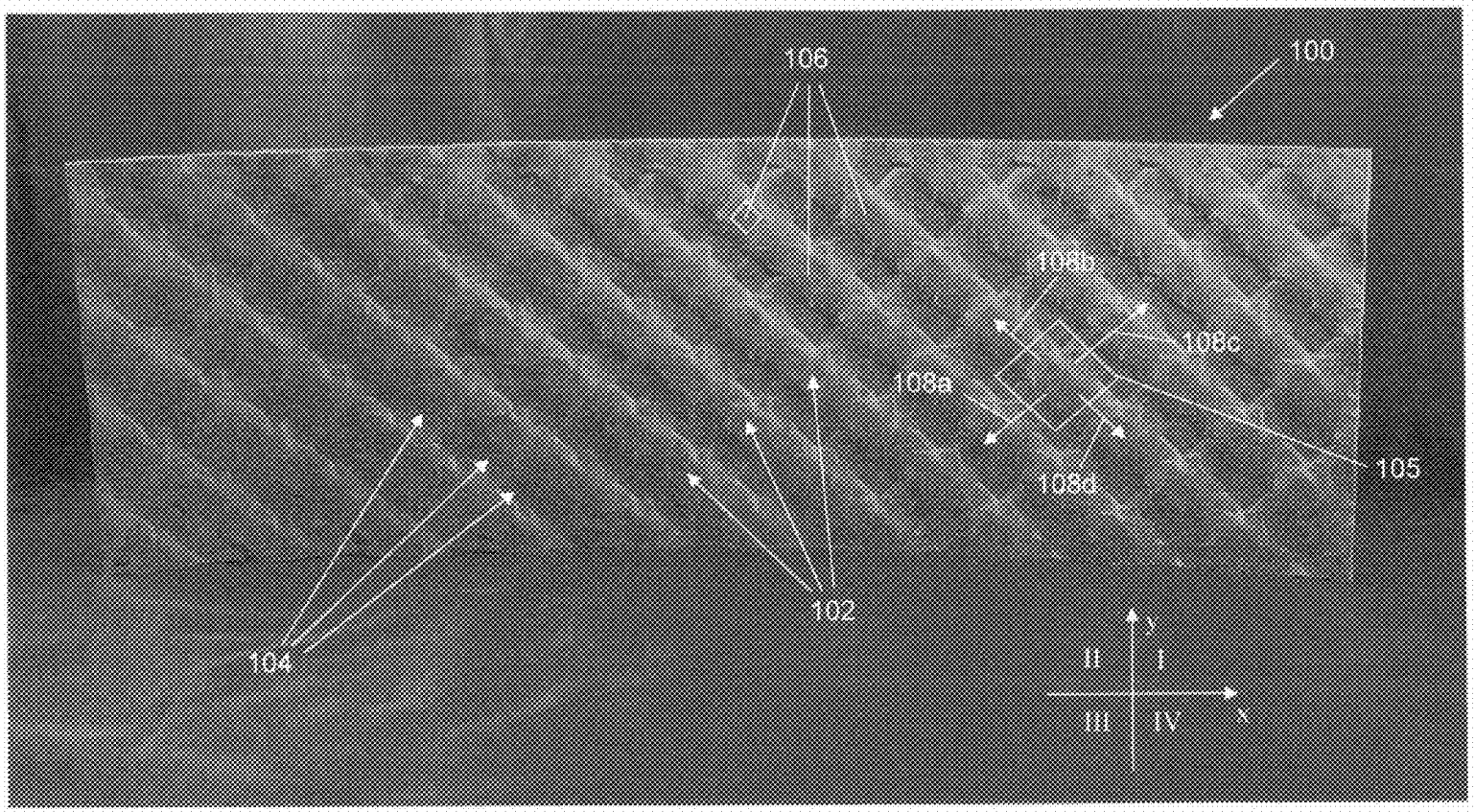
FIG. 1 is a photograph depicting a collapsible layer useful in the practice of the invention, in accordance with one embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Throughout this specification and the appended claims, the term "atomic region" of a sheet refers to a three-dimensional (i.e., non-planar) surface structure that projects out of the two-dimensional plane of the sheet, wherein the normal vectors to the surfaces of the atomic region, when projected onto the two-dimensional plane of the sheet, lie in a plurality of different non-collinear directions. In contrast, the flutes of conventional corrugated paper have normal vectors that lie in a single direction as noted above, and thus are not atomic regions as used herein.

"Z-direction" means the direction normal to the two-dimensional plane of the sheet.

The "effective caliper $t_{eff}$" is the distance measured in the Z-direction between one surface containing the highest points on one side of the layer and another surface containing the highest points on the opposite side of the layer. Unless otherwise noted, effective calipers referred to herein were measured using the TAPPI T411 om-89 test protocol.

"Collapsible" means that the layer can be reduced in effective thickness or caliper $t_{eff}$ by pressure exerted on the layer along the Z-direction, as a result of the atomic regions being compressed and flattened out.

The "total amount ΔR" of Z-direction collapsibility of a layer is the maximum amount by which the effective caliper $t_{eff}$ can be reduced solely as a result of flattening out of the atomic regions. Thus, ΔR substantially excludes caliper reduction resulting from compressing the basic fiber structure (i.e., reducing the volume of the inter-fiber and intra-fiber spaces) of the paperboard in the Z-direction, although it must be recognized that unavoidably some amount of fiber compression always occurs when compressing paperboard.

The present disclosure relates to winding cores for winding rolls of elastically stretched or shrinkable material, and methods for making such winding cores. Such materials include but are not limited to certain types of plastic film, shrink film, certain types of yarn or other textile material, and the like. The winding of such materials presents challenges that are not encountered in the winding of relatively inelastic materials such as paper or metal sheet materials, as a result of the substantial roll strain energy that exists in the roll of wound material. The roll strain energy results from the tension under which the film is wound around the core. This mechanism is analogous to a spring that stores energy when deformed. For wound roll structures, roll strain energy compresses the core OD, causing a reduction in the inside diameter or "ID comedown".

As previously noted, the general notion of including one or more conventional corrugated paperboard layers in a winding core wall structure for absorbing some of the deformation of the core OD caused by the pressure exerted by the wound material, has been known for quite some time, as exemplified by CH 549 523 and U.S. Pat. No. 2,350,369. However, based on work conducted by the applicant, winding cores having corrugated paperboard are deficient in one or more notable respects. In particular, as further described below, testing by the applicant has shown that a corrugated layer can be prone to abrupt and substantially complete collapse almost immediately after winding of the material begins. This collapse furthermore does not necessarily occur in a completely uniform manner about the core circumference, with the result that the core OD can become non-round, leading to high vibration requiring the winding process to be aborted or slowed down appreciably. Furthermore, from a practical standpoint, rolls of pre-corrugated paperboard for making cores of the type described in the CH '523 reference would have to be very large in order to avoid the necessity of frequent roll changes during tube manufacture. Alternatively, an in-line corrugating device would have to be developed, but it is suspected that making a reliable in-line corrugator with a small-enough footprint to be practical, and able to run at the high speeds necessary for economical tube manufacture, would be quite difficult.

The applicant has developed alternative collapsible layers that substantially or entirely avoid the abrupt and non-uniform collapse and its consequent vibration problem that cores with corrugated paperboard are prone to. The collapsible layers are based on structured atomic regions and therefore have a number of advantages over conventional corrugated structures: (1) the layers can provide a substantial degree of Z-direction collapsibility ΔR; (2) notwithstanding such large collapsibility, the layers tend to collapse in a more-controlled fashion (i.e., not abruptly and substantially completely upon winding, the way conventional corrugated tends to do); (3) the layers tend to collapse in a more-uniform fashion about the core circumference and thereby avoid vibration problems; (4) the layers have substantially better "runnability" in a spiral tube-making process because of their ability to be bent in multiple directions with little or no fiber breakage; and (5) a normal force exerted on the atomic regions is transmitted from the Z-direction into multiple in-plane directions, rather than in just one direction as with conventional corrugated structures.

A collapsible structure 100 in accordance with one embodiment of the invention is shown in FIG. 1. In the photograph of FIG. 1, the structure comprises a paperboard sheet that is structured (e.g., by passing the sheet through a nip between two rollers having three-dimensionally structured surfaces in the desired shape). Alternatively, the structure could be formed of non-paper materials such as polymer film (e.g., by thermoforming, cold-forming, or the like). For recyclability of the core made with the structure, it is preferred that the collapsible structure be made of the same material as the other layers of the core. The structure 100 has a "waffle" or grid pattern of atomic regions. That is, the structure comprises a sheet that is structured to have a series of first generally square or rectangular raised regions 102 that project outwardly from one side of the sheet and a series of second generally square or rectangular raised regions 104 that project out from the opposite side of the sheet. The first and second regions 102, 104 repeat along two different orthogonal directions in the two-dimensional plane of the sheet. The resulting structure 100 has a surface defined by atomic regions 105 that repeat throughout the sheet. More particularly, the atomic regions 105 form peaks and valleys that repeat along two orthogonal directions in the plane of the sheet.

The structure 100 is also characterized in that the raised regions 102, 104 have uppermost surfaces 106 (one of which is outlined with lines in FIG. 1) that are substantially planar. These substantially planar uppermost surfaces thus are formed on both sides of the structure 100 and form good adhesion points to the adjacent layers in a wound tube. In preferred embodiments, each substantially planar surface 106 has a surface area of at least about 0.05 $in^2$ (32 $mm^2$), or at least about 0.1 $in^2$ (64 $mm^2$). Each of the four edges of the uppermost surface 106 is joined with a generally rectangular surface portion that is inclined relative to the two-dimensional plane of the sheet. These four surface portions have normal vectors that when projected onto the two-dimensional plane of the sheet lie in different directions. Thus, one surface portion's normal vector 108*a* is directed toward quadrant III of an x-y coordinate system (the y-direction being parallel to the length or machine direction of the sheet, and the x-direction being parallel to the width or cross-machine direction of the sheet). Another of the surface portion's normal vector 108*b* is directed toward quadrant II, yet another surface portion's normal vector 108*c* is directed toward quadrant I, and the fourth surface portion's normal vector is directed toward quadrant IV. The normal vector to the uppermost surface 106 is generally parallel to the z-direction.

Figure 2:
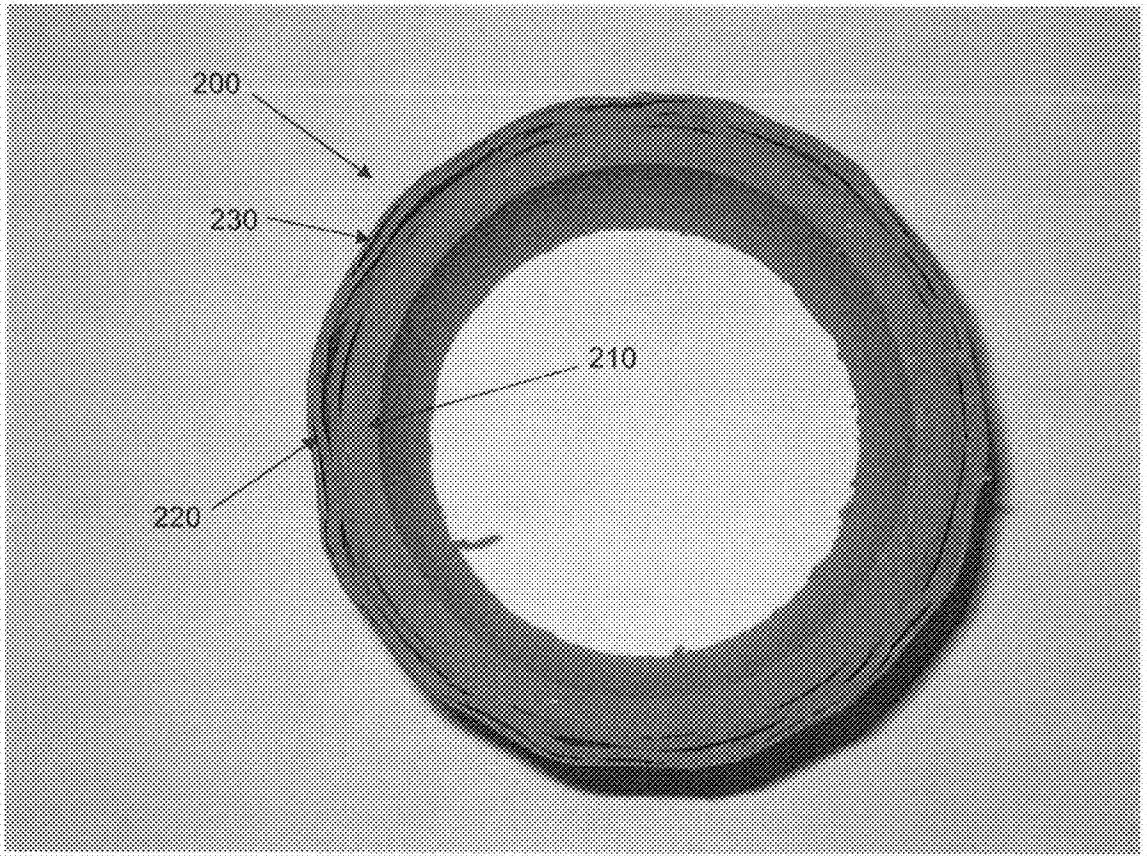
FIG. 2 is a photograph depicting a short length of a winding core having one collapsible layer of the type shown in FIG. 1.
Figure 3:
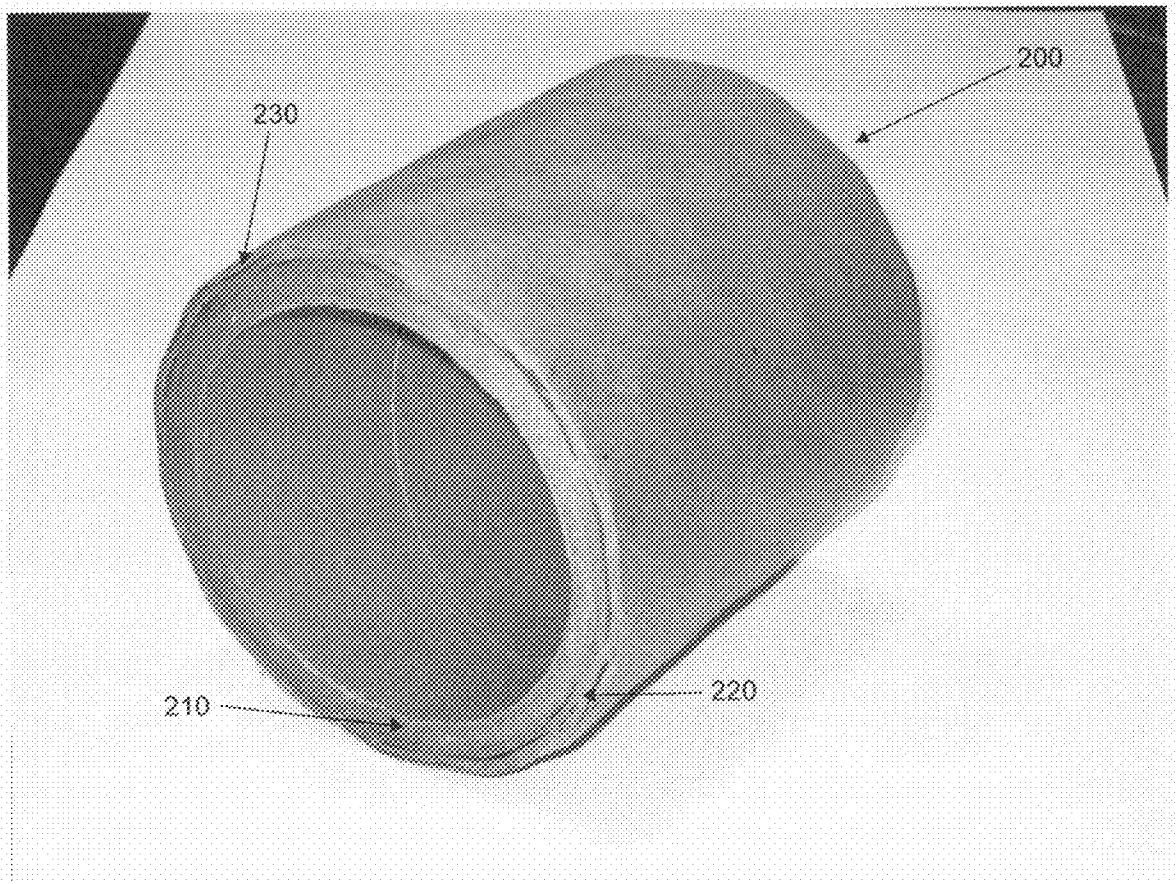
FIG. 3 is another photograph of the winding core of FIG. 2.

The collapsible structure 100 is useful in the construction of winding cores in accordance with the present invention. For example, FIGS. 2 and 3 show a sample length of paperboard winding core 200 constructed with a collapsible paperboard layer generally as shown in FIG. 1. The core 200 includes an inner shell 210 formed by a plurality of inner paperboard layers helically wrapped one upon another about the core axis and adhered together with adhesive. In the illustrated embodiment, the inner shell comprises 11 inner paperboard layers, all of which have opposite surfaces that are smooth and non-undulating (i.e., they are conventional flat paperboard plies). The inner paperboard layers have a caliper of about 0.025 inch (0.64 mm). The core 200 also includes an outer shell 230 formed by a single smooth non-undulating paperboard layer having a caliper of about 0.013 inch (0.33 mm). The core further includes an energy-absorbing zone 220 formed by a single collapsible paperboard layer generally of the grid type shown in FIG. 1. The collapsible paperboard layer is formed from a sheet of paperboard having a caliper of about 0.015 to 0.050 inch (0.38 to 1.27 mm). The atomic regions formed into the sheet, however, give the sheet an effective caliper $t_{eff}$ of approximately 0.030 to 0.250 inch (0.76 to 6.4 mm). In general, the effective caliper of the collapsible paperboard layer is at least twice the actual caliper of the sheet, or at least 2.5 times the actual caliper, or at least 3 times the actual caliper, or at least 4 times the actual caliper, or at least 5 times the actual caliper. These numbers are merely exemplary, and winding cores in accordance with the invention are not limited to any particular number or calipers of the various paperboard layers, except that the inner shell generally requires a plurality of paperboard layers for adequate ID stiffness (i.e., a measure of the resistance of the core to ID comedown under a radially inward compressive load), radial crush strength, and bending stiffness.

Figure 4:
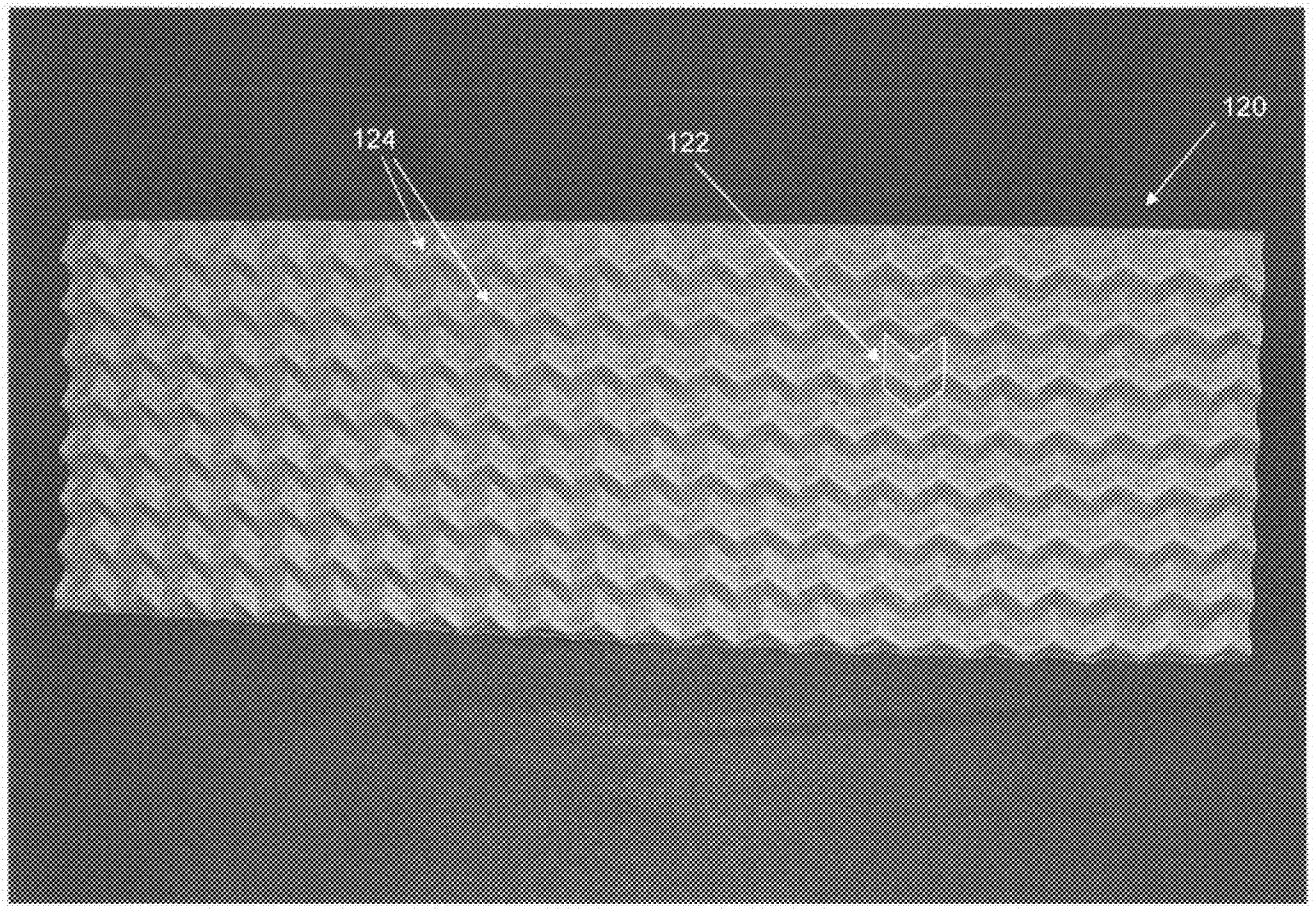
FIG. 4 is a photograph depicting a collapsible layer in accordance with another embodiment of the invention.
Figure 4A:
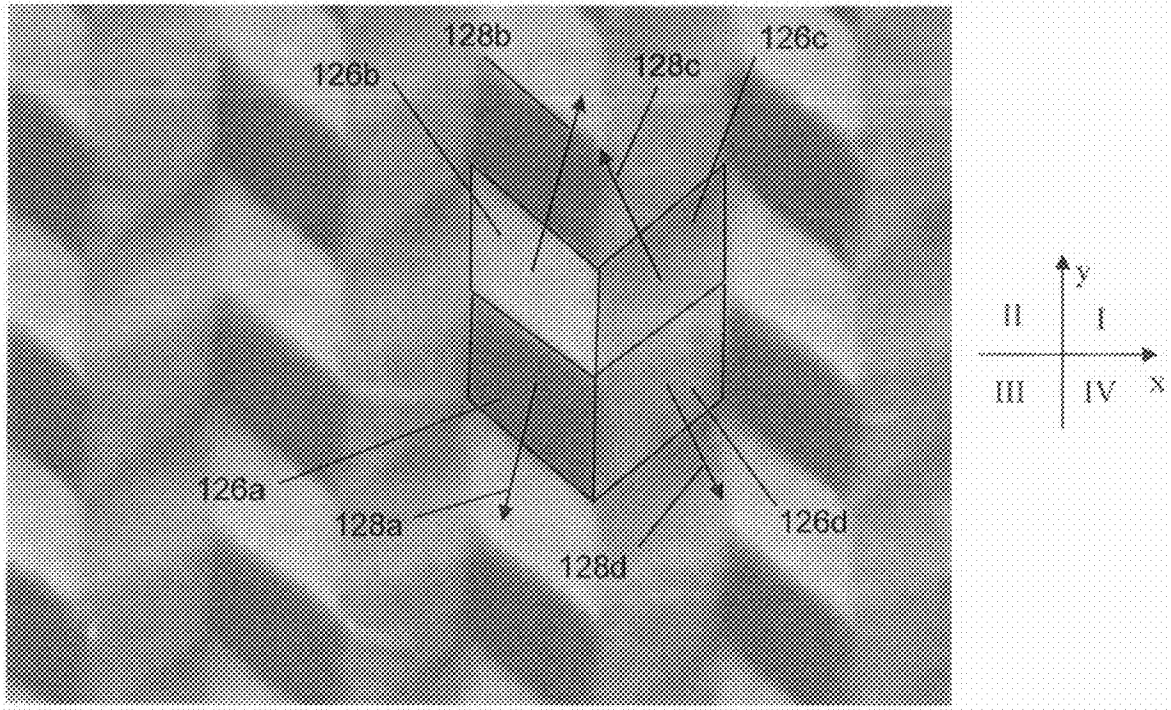
FIG. 4A is a magnified portion of FIG. 4.

A second embodiment of a collapsible layer 120 useful in the practice of the present invention is shown in FIGS. 4 and 4A. The layer 120 has atomic regions 122 formed by folded tessellations 124 that have a generally zigzag shape along a length or machine direction of the layer. The layer 120 can be, for example, a paperboard formed in accordance with U.S. Pat. No. 7,115,089 and U.S. Patent Application Publication 2006/0148632, the disclosures of which are incorporated herein by reference. The atomic region 122 has a chevron shape and is defined by four substantially planar surfaces 126*a*, 126*b*, 126*c*, 126*d* (FIG. 4A) that are in different orientations relative to one another. The surface 126*a* has a generally parallelogram shape and has a surface normal vector 128*a* that in two-dimensional x-y projection is directed toward quadrant III. The surface 126*b* has a generally parallelogram shape and has a surface normal vector 128*b* that in two-dimensional x-y projection is directed toward quadrant I. The surface 126*c* has a generally parallelogram shape and has a surface normal vector 128*c* that in two-dimensional x-y projection is directed toward quadrant II. The surface 126*d* has a generally parallelogram shape and has a surface normal vector 128*d* that in two-dimensional x-y projection is directed toward quadrant IV. Each of these surfaces is inclined out of the two-dimensional plane of the sheet. In general, the effective caliper of the layer 120 is at least twice the actual caliper of the sheet, or at least 2.5 times the actual caliper, or at least 3 times the actual caliper, or at least 3.5 times the actual caliper, or at least 4 times the actual caliper, or at least 5 times the actual caliper, or at least 6 times the actual caliper. In some cases, the collapsible layer 120 can have an effective caliper at least 8 times the actual caliper, or at least 10 times the actual caliper, or at least 15 times the actual caliper, or even at least 20 times the actual caliper.

Figure 5:
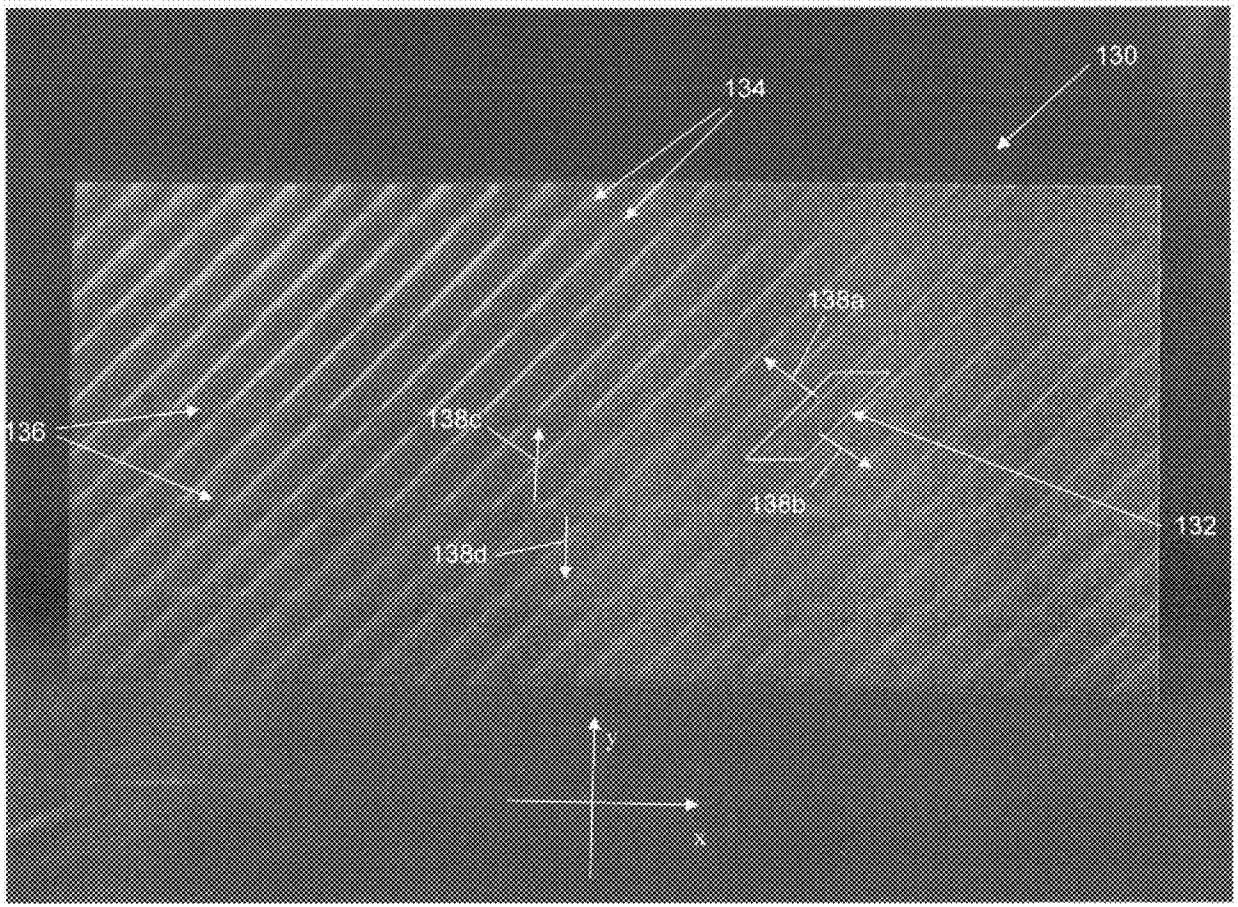
FIG. 5 is a photograph showing a collapsible layer in accordance with still another embodiment.

A collapsible structure 130 in accordance with a further embodiment of the invention is shown in FIG. 5. The structure 130 has a grid pattern of atomic regions 132 that repeat along two directions in the plane of the sheet. In particular, each atomic region has a first generally linear raised region 134 that extends along a first direction (lower left to upper right in FIG. 5) and that intersects a second generally linear raised region 136 that extends along a second direction (left to right in FIG. 1). The first and second directions in the embodiment of FIG. 5 are non-orthogonal to each other. The first raised region 134 includes surface portions having normal vectors 138*a* and 138*b* that in two-dimensional projection are respectively directed toward quadrants II and IV. The second raised region 136 includes surface portions having normal vectors 138*c* and 138*d* that are respectively directed toward the positive y-direction and the negative y-direction. In general, the effective caliper of the layer 130 is at least twice the actual caliper of the sheet, or at least 2.5 times the actual caliper, or at least 3 times the actual caliper.

A series of trials was conducted to assess the effectiveness of various winding core structures at resisting ID comedown when wound with rolls of both blown and cast 80-gauge plastic film. All of the winding cores had a nominal ID of 77.8 mm (3.062 inches) and a length of 21 inches (533 mm). Table I below indicates the build-up of the various cores.

TABLE I

| Core Designation | Core Build-up (ID → OD) | Core Weight (g) |
|---|---|---|
| Control | 1-P4/5-P3/6-P2/1-P4/1-Out | 978.3 |
| A30 | 11-P4/1-G(P5)/1-Out | 853.7 |
| A33 | 9-P4/1-G(P6)/1-Out | 716.7 |
| A34 | 9-P4/1-G(P6)/1-Out/1-G(P6)/1-Out | 863.6 |
| A35 | 6-P4/3-P4'/1-G(P6)/1-Out | 731.1 |
| A36 | 11-P5/1-G(P6)/1-Out | 818.8 |
| A37 | 10-P4/1-G(P6)/1-Out | 747.3 |
| A38 | 8-P4/1-P2/1-G(P6)/1-Out | 682.8 |
| A39 | 9-P4/1-G(P5)/1-Out | 678.6 |
| A40 | 6-P4/4-P2/1-G(P6)/1-Out | 778.8 |
| A41 | 5-P4/2-P2'/2-P2/1-G(P6)/1-P4/1-Out | 779.8 |
| Corrugated 1 | 11-P4/1-Corr/1-Face | 694.5 |
| Corrugated 2 | 11-P4/1-Face/1-Corr/1-Face/1-Corr/1-Face | 1058 |

P1 = Low-density paperboard of 0.025 inch (0.64 mm) caliper
P2 = Low-density chip paperboard of 0.025 inch (0.76 mm) caliper
P2' = Low-density chip paperboard of 0.030 inch (0.76 mm) caliper
P4 = Medium-density paperboard of 0.025 inch (0.64 mm) caliper
P4' = Medium-density paperboard of 0.030 inch (0.76 mm) caliper
P5 = High-density paperboard of 0.030 inch (0.76 mm) caliper
P6 = Low-to medium-density paperboard of 0.045 inch (1.14 mm) caliper
Out = Paperboard of 0.013 inch (0.33 mm) caliper
G = "Grid" type collapsible paperboard generally of the type shown in FIG. 1, having an effective caliper of about 0.120 inch (3.0 mm) in the case of P6, and about 0.150 inch (3.8 mm) in the case of P5
Corr = Conventional 0.006 inch (0.15 mm) corrugated paperboard having B-flutes (approximately 47 flutes per linear foot), giving an effective caliper (including one Face sheet) of about 0.10 inch (2.5 mm)
Face = 0.006 inch (0.15 mm) face sheets for the corrugated plies Thus, for example, the A37 core had 10 plies of P4 paperboard forming the inner shell, one ply of the Grid-type paperboard (made from P6 paperboard) forming the energy-absorbing zone, and one ply of 0.013 inch (0.33 mm) paperboard forming the outer shell. The Control core was representative of a "conventional" core constructed entirely of flat non-undulating paperboard plies. The Corrugated cores were at least somewhat representative of winding cores of the type described in CH 549 523 and U.S. Pat. No. 2,350,369.

The cores were tested for ID comedown by winding each of the cores with the same length of plastic film at the same winding tension. Sixteen samples of each core type were tested with blown film, and twelve samples of each core type were tested with cast film. The inside diameter of each core was measured seven inches (178 mm) from each end and the two measurements were averaged and subtracted from the starting value of inside diameter before winding to derive the ID comedown. These measurements were made at the following times: before winding (BW), immediately after winding (AW), 20 minutes after winding, 24 hours after winding, 48 hours after winding, 144 hours after winding, 168 hours (one week) after winding, 216 hours after winding, and 336 hours (two weeks) after winding.

Figure 6:
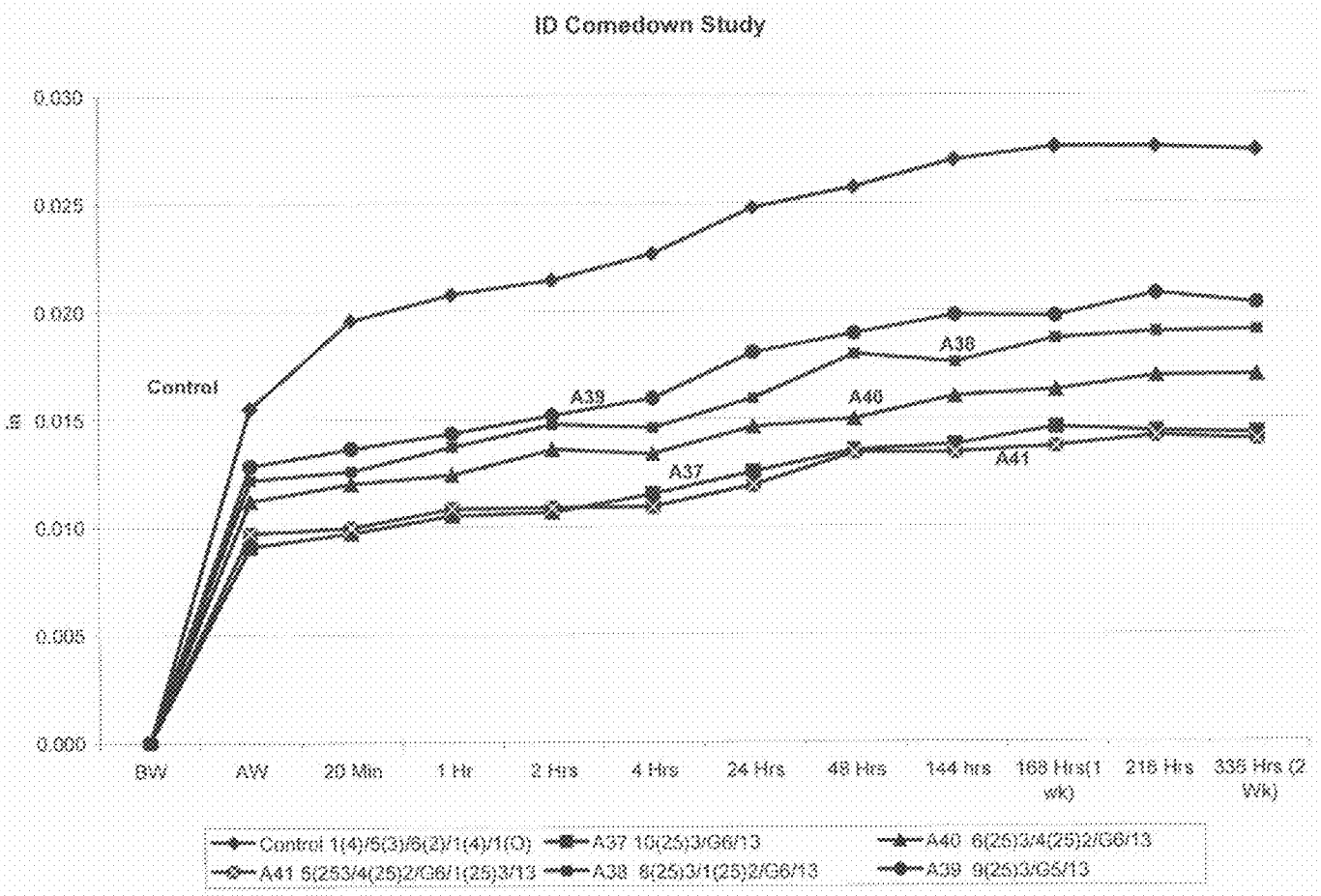
FIG. 6 is a plot showing results of ID comedown tests on conventional cores and cores in accordance with the invention wound with plastic film.

The results of the tests are shown in FIG. 6. Each data point represents an average of the 16 core samples with blown film and the 12 core samples with cast film. The Corrugated cores experienced high vibration during high-speed winding (approximately 250 feet/minute) such that the winding operations had to be aborted. It is theorized that the corrugations of the corrugated ply abruptly collapsed soon after winding began, and the collapse was not uniform about the circumference, such that the core became non-round and caused high vibration. By winding the film onto the Corrugated cores at a lower speed, it was possible to complete the winding and to measure the ID comedown. However, the Corrugated cores were considered to be a failure because it would not be practical to wind at the low speed that had to be employed.

At the moment when winding was completed (time AW), the test results show that there were already significant differences in the ID comedown of the various cores. The Corrugated 1 core had the largest ID comedown (which is not shown in FIG. 6 because, as noted previously, the test was considered a failure in that high vibrations prevented high-speed winding). The next highest ID comedown at time AW was for the Control core (0.0155 inch). The A37 core at time AW had the lowest ID comedown at about 0.009 inch, which was a reduction of about 40% in ID comedown compared to the Control core. This is believed to be a result of the A37 core relieving a substantial amount of the roll strain energy by absorbing deformation of the core OD in the energy-absorbing zone formed by the Grid-type collapsible paperboard layer.

Interestingly, the test results show that ID comedown continued to increase, and in some cases quite significantly, for a substantial period of time after winding was completed. This is an indication that the roll strain energy in the wound film rolls was continuing to exert substantial pressure on the cores. For example, for the Control core, the ID comedown increased from about 0.0155 inch immediately after winding to about 0.0196 inch (about a 26% increase) 20 minutes after winding. Twenty-four hours after winding, the Control core's ID comedown had increased to about 0.0248 inch (about a 60% increase). The Control core's ID comedown continued to increase for up to about 168 hours (one week) after winding, peaking at about 0.0276 inch (78% higher than immediately after winding).

The A37 core's ID comedown also continued to increase after winding. For example, 20 minutes after winding, the A37 core's ID comedown was substantially the same as after winding. Twenty-four hours after winding, the A37 core's ID comedown had increased from about 0.009 inch to about 0.0125 inch (about a 39% increase, compared to 60% for the Control core). The A37 core's ID comedown continued to increase up to about 168 hours (one week) after winding, peaking at about 0.0146 inch (62% higher than immediately after winding). Thus, even one week after winding, the A36 core's total ID comedown was still less than that of the Control core immediately after winding even though the A36 core used significantly less paper than the Control core.

The other energy-absorbing cores also resulted in substantially lower ID comedown values than the Control core. For example, the A40 and A41 cores were nearly as good as the A37 core.

Figure 7:
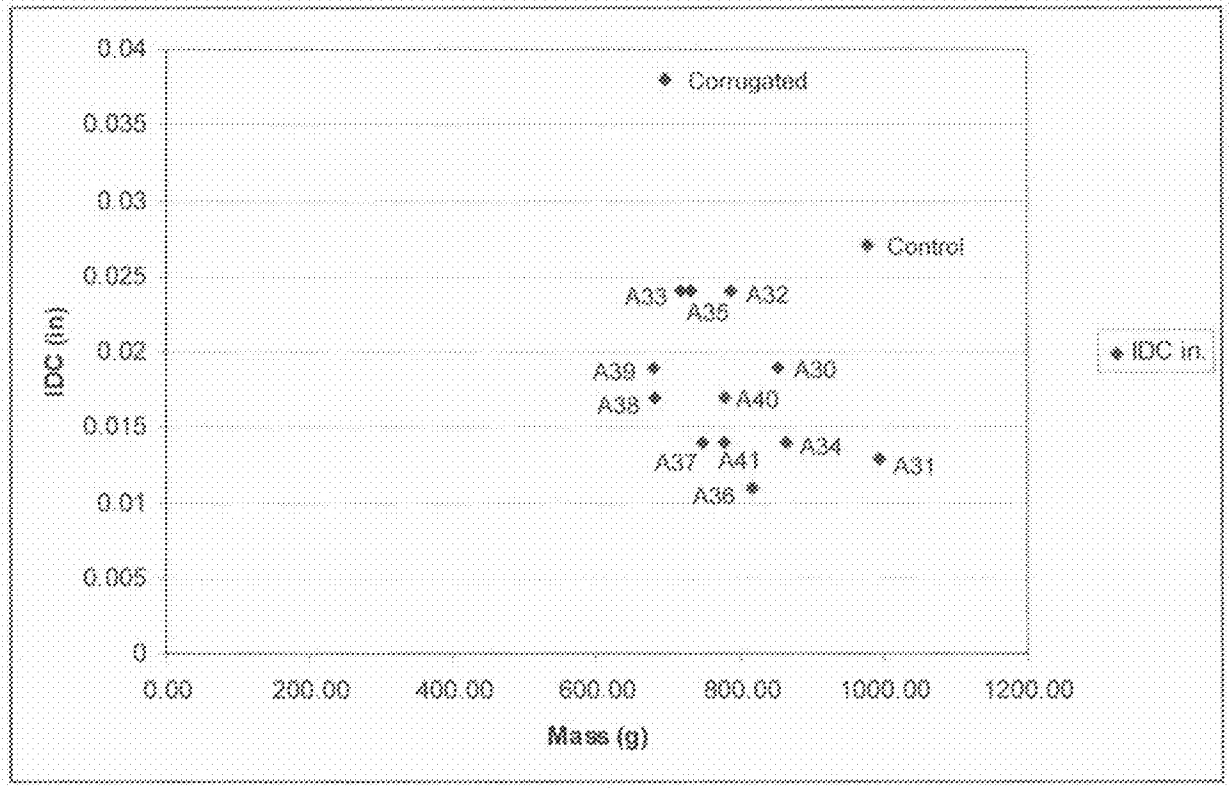
FIG. 7 is a plot showing how ID comedown relates to weights of the tested cores.

It is of interest to note how the ID comedown values relate to the weight of each core. In designing a core for a particular application, generally it is desirable to use as little fiber mass as possible while still achieving adequate ID stiffness. FIG. 7 shows the ID comedown values of the various cores two weeks after winding, plotted versus the weights of the cores. The core of highest weight was the A31 core at 995.6 g, which was only slightly greater than the Control core (978.3 g). However, the A31 had an ID comedown of only 0.013 inch, versus 0.027 inch for the Control core. Thus, at approximately the same weight, the inventive core resulted in a reduction in ID comedown of about 50%. The core of lowest weight was the A39 core at 678.6 g (a 30% reduction relative to the Control core), and yet it had a significantly lower ID comedown (0.019 inch) in comparison to the Control core (0.027 inch). Additionally, the A36 core achieved the lowest ID comedown (0.011 inch), but it required about 16% less paper mass than did the Control core (818.8 g for A36, versus 978.3 g for the Control). Thus, since the Control core is deemed to have acceptable ID comedown performance, it is possible to dramatically reduce the amount of paper mass while still achieving adequate ID comedown performance.

The Corrugated-1 core was poor in performance in comparison to the inventive cores. For example, the Corrugated-1 core two weeks after winding had an ID comedown of 0.038 inch (not acceptable) at a weight of 694.5 g. However, the A38 core at approximately the same weight (682.8 g) had an ID comedown of only 0.017 inch (acceptable), less than half that of the Corrugated-1 core.

The test results show that through proper selection of ply types and numbers and proper design of the energy-absorbing zone, a target maximum ID comedown can be achieved for a particular winding application while reducing the amount of material usage relative to conventional winding cores.

A further advantageous and unexpected characteristic of the winding cores in accordance with the invention relates to the amount by which a core grows in length as a result of the compressive forces exerted by the roll of wound material. It has been observed that as a winding core is reduced in ID, the length of the core grows. Length growth in some applications can be a serious concern. For example, in applications where a plurality of winding cores are mounted end-to-end on a winding mandrel and a plurality of webs of plastic film simultaneously are wound onto the respective cores, the length growth of the cores is additive (e.g., if each core grows in length by 0.05 inch, and there are five cores, the total length growth is 0.25 inch). This can result in a given core being displaced from its desired position by a significant amount, such that the film web is no longer properly aligned with the core. This can lead to non-uniform wound rolls.

Figure 8:
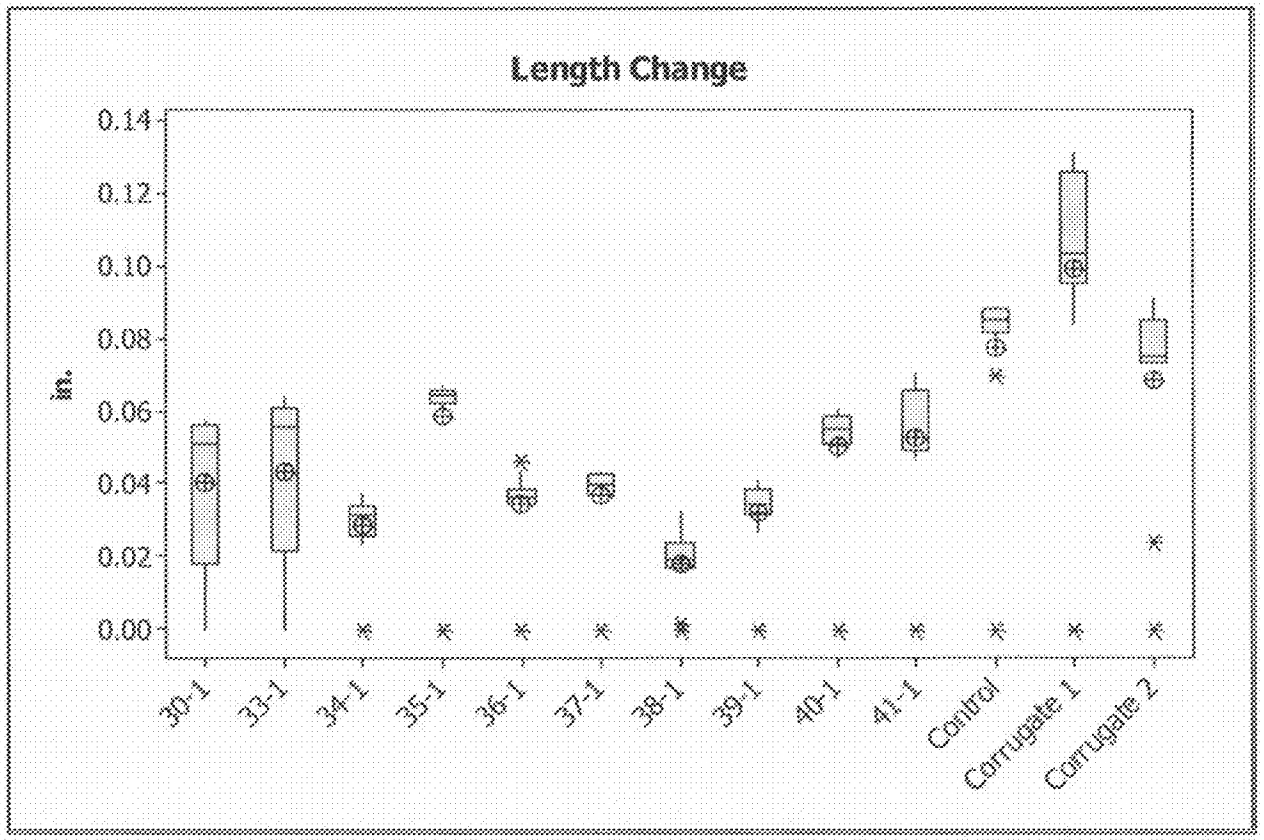
FIG. 8 is a plot showing how the lengths of the cores changed as a result of the pressure exerted by the wound plastic film.

However, the cores constructed in accordance with the present invention exhibited a substantially lower length growth than the Control and Corrugated cores. A box-and-whisker plot of the length growth measurement taken about two weeks after winding is shown in FIG. 8. For each core tested, the rectangular shaded box represents the middle 50% of the range of length growth data points. The horizontal line through the box represents the median. The vertical lines ("whiskers") extending from the box represent the upper and lower 25% of the data range (excluding outliers). Outliers are represented by asterisks (*). The circle-and-crosshair symbol on each plot represents the mean of the data points. It can be seen that the cores constructed using the Grid-type collapsible paperboard layers in accordance with the invention had significantly lower length growth than that of the Control and Corrugated cores. In fact, the "Corrugated 1" core had the highest mean length growth of about 0.10 inch, and the Control core had the next-highest mean length growth of about 0.078 inch. In contrast, the A38 core had a mean length growth of only about 0.02 inch. The A34 core's mean length growth was about 0.03 inch. Several of the other cores in accordance with the invention had mean length growths below 0.05 inch, which was deemed to be the maximum allowable value.

This is believed to reflect the amount of energy transfer from the wound roll of material to the inner shell of the core (or to the entire core in the case of the Control core). More particularly, the energy-absorbing zone of each of the inventive cores converts the roll strain energy into other forms of energy that are not able to contribute toward length growth. In contrast, proportionally more of the roll strain energy of the wound material is able to contribute toward length growth of the Control core because it lacks any effective energy-absorbing capability. Likewise, while the Corrugated cores were able to collapse at the OD, as previously noted, the collapse occurred too abruptly to be effective at converting roll strain energy into other energy forms.

The inventive cores thus provide substantial reductions in ID comedown and length growth over a prolonged period of time after winding, and are dramatically better in these respects than the conventional type of core having no energy-absorbing zone. Additionally, and even more surprising, is the fact that the inventive cores are substantially better than cores having corrugated material for absorbing deformation applied to the core OD.

In order to be able to distinguish between collapsible structures that are "good" such as the folded and grid-type structures described above, and structures that are "poor" such as conventional corrugated materials, a series of compressive load tests were performed on generally planar samples of materials of various types, including samples having ordinary flat paperboard, samples having one or two grid-type collapsible paperboard layers (e.g., as in FIG. 1), samples having one or two folded-type collapsible paperboard layers (e.g., as in FIG. 4), samples having one or two embossed paperboard layers, and samples having one or two corrugated layers. Each sample consisted of a base of 10 plies of the same medium-density P4' (0.030 inch thick) paperboard used in the construction of the cores as previously described, to which the subject material being tested was adhesively laminated. The samples had approximate length and width dimensions of three inches by three inches.

In the case of the grid-type samples, an additional variable that was explored was the density of the paperboard. More particularly, three different grades of paperboard materials (low-density P1, low- to medium-density P6, and medium-density P4) were made into grid-type collapsible layers, and samples having both one and two layers of each type were tested.

The testing consisted of compressively loading each sample in a Material Testing System model 831 hydraulic elastomer test system under displacement control, and periodically measuring the force and displacement during the test. To test a given sample, the sample was placed on the test plate of the machine and the lock/unlock handle of the machine was operated to cause the machine head to exert a small compressive load of about 10 to 40 N (2.3 to 9 pounds) on the sample. This small load was just enough to ensure that the sample was lying flat on the test plate; in this condition, the load was deemed to be "zero", and thus the load cell of the machine was zeroed out. The machine was then started such that the test head moved at a predetermined speed of about 1.6 mm per minute for a total time of 5 minutes (a total travel of 8 mm). During the test, the displacement and load were recorded at intervals of 0.02 second. The total strain energy (load multiplied by displacement) was calculated for each data point.

Figure 9:
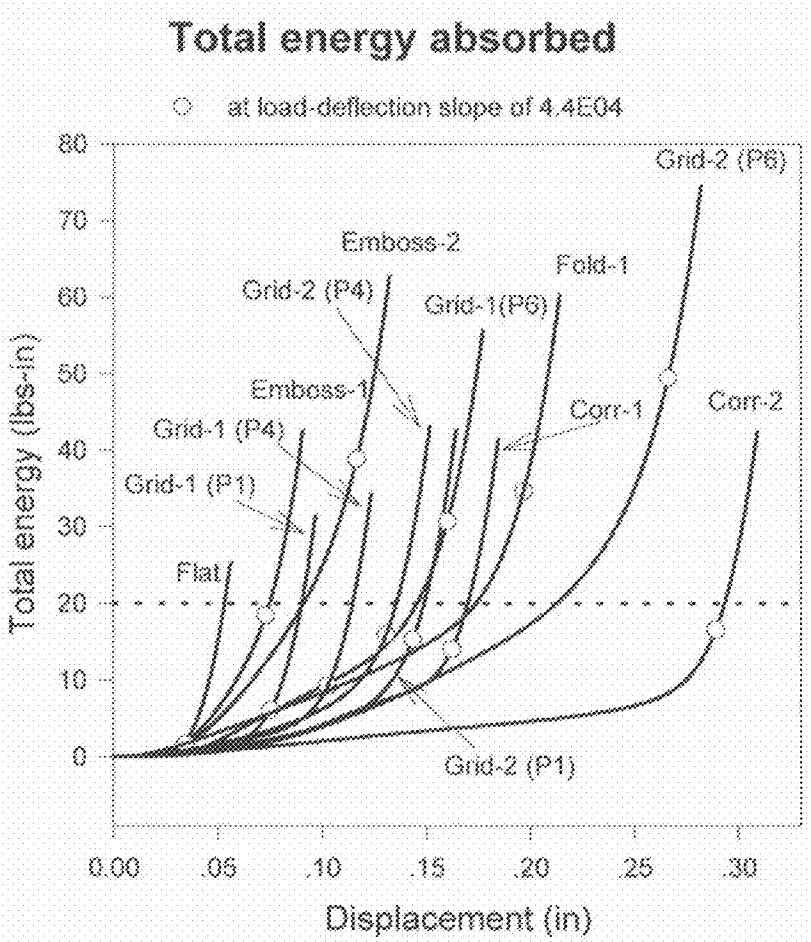
FIG. 9 is a plot showing load-displacement characteristics of various tested laminate materials some of which are and some of which are not suitable for constructing winding cores in accordance with the invention.

FIG. 9 shows total strain energy input into each sample (in units of lb-inches) versus displacement. Strain energy was computed by numerically integrating the area under the load-displacement curve, as the summation of $[F(X_{i+1})+F(X_i)]*(X_{i+1}-X_i)/2$, where F(X) is the load as a function of displacement X, and i=1 to n−1, where n is the number of data points making up the curve. Each sample of corrugated and structured paperboard has generally the same characteristic whereby the displacement initially increases at a relatively high rate per unit of energy. It is thought that this initial rapid displacement is made up predominantly of the collapsing or flattening out of the corrugations or atomic regions, as opposed to compression of the fibrous structure of the paperboard material itself. With further energy input, the rate of increase of displacement then diminishes markedly. It is thought this indicates that the flattening out of the corrugations or atomic regions is substantially completed, and further displacement is accomplished more by compression of the fibrous structure itself than by flattening out of the atomic regions. It was determined that a load-displacement slope of 44,000 lb/inch was fairly representative of the point at which the type of compression changed from flattening out of the atomic regions to compression of the fibrous structure. The point at which the slope equals 44,000 lb/inch is represented by an open circle on each curve in FIG. 9. A minimum acceptable level of strain energy at the 44,000 lb/inch slope was established as 20 lb-inches. Thus, all materials below 20 lb-inches are deemed unacceptable, and all materials above 20 lb-inches are deemed acceptable.

It can be seen that the two types of corrugated samples having one or two layers of corrugated material reach the 44,000 lb/inch slope at relative low energy levels of 14 and 15.9 lb-inches, respectively, and large displacements are achieved. This is consistent with the previous observations that corrugated material collapses rapidly and with little force. It is of interest to note that the sample having a single layer of the folded type collapsible paperboard generally as shown in FIG. 4 had an energy of about 35 lb-inches. The laminate having a single layer of grid-type material as in FIG. 1 made from the low- to medium-density P6 paperboard had an energy of about 31 lb-inches; the laminate having two layers of this grid-type material had an energy of about 50 lb-inches, which was the highest among the structures tested. Thus, the "macroscopic" structure of the material played a significant role in determining the level of strain energy at the designated 44,000 lb/inch slope point.

A particularly noteworthy finding, furthermore, is that the "microscopic" structure (i.e., the density) of the paperboard of which the grid-type structure was made was also a significant parameter. The laminates having one or two layers of grid-type material made from medium-density P4 paperboard (0.025 inch caliper) had an energy at the designated slope point of 9.2 lb-inches and 15.9 lb-inches, respectively, which was roughly comparable to the energy levels of the corrugated samples. However, the laminates having one or two layers of grid-type material made from low- to medium-density P6 paperboard (0.045 inch caliper) had energy levels of 30.7 lb-inches and 49.5 lb-inches, respectively, more than triple the energy levels for the P4 paperboard. The laminates having one or two layers of grid-type material made from low-density P1 paperboard (0.030 inch caliper) had low energy levels of 6.1 and 15.3 lb-inches, respectively. Thus, despite the P1 paperboard's somewhat greater caliper than the P4 paperboard, it appears the P4 paperboard's greater density compensated for the reduction in caliper. The high energy levels of the P6 paperboard structures also reflect the fact that P6's caliper was almost double that of P4.

These flat laminate test results can be used as a guide in selecting suitable collapsible energy-absorbing zones for use in winding cores. As previously noted, a general guideline at least with respect to collapsible paperboard structures is that the strain energy of the energy-absorbing zone at a load-displacement slope of 44,000 lb/inch should be at least about 20 lb-inches. It should be noted that this lower limit is applicable to winding cores for stretch film. For other applications such as winding cores for shrink film or other material, a different lower limit for strain energy may apply.

In accordance with the invention, a method for designing or constructing a winding core for a particular winding application includes the step of taking into account the post-winding effect of continued roll strain energy on the core, and providing the core with an energy-absorbing zone having sufficient collapsibility to absorb at least a substantial amount of the roll strain energy both during and for a prolonged time after winding.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A winding core for winding a continuous web of elastically stretchable or shrinkable material to form a roll of the material, wherein the roll has a roll strain energy resulting in a radially inward pressure on the core, the winding core comprising:

a cylindrical structure formed of a plurality of layers wound one upon another about an axis and adhered together, wherein the core comprises:

a radially inner shell formed by a plurality of inner layers each having opposite substantially smooth and non-undulating surfaces; and an energy-absorbing zone disposed radially outwardly of the inner shell, the energy-absorbing zone comprising at least one collapsible layer formed from a sheet that is structured such that each of the opposite surfaces of the sheet defines a three-dimensional structured atomic region that is repeated throughout the surface, the atomic region projecting out of a plane of the sheet and defining a plurality of normal vectors in different sub-regions of the atomic region, wherein the normal vectors, when projected onto the two-dimensional plane of the sheet, are in a plurality of different non-collinear directions in said plane, wherein each collapsible layer and each inner layer is formed of paperboard, and wherein the energy-absorbing zone has a strain energy of at least about 20 lb-inches at a load-displacement slope of 44,000 lb/in.

2. The winding core of claim 1, wherein each collapsible layer has an actual caliper of about 0.013 inch to about 0.050 inch and an effective caliper of about 0.030 inch to about 0.250 inch.

3. The winding core of claim 1, wherein the inner shell comprises inner paperboard layers of two or more different grades.

4. The winding core of claim 3, wherein the inner shell has one or more relatively higher-grade inner paperboard layers located radially inwardly of one or more relatively lower-grade inner paperboard layers.

5. The winding core of claim 1, further comprising an outer shell formed by at least one outer layer wrapped about and adhered to the energy-absorbing zone.

6. The winding core of claim 1, wherein the atomic regions of one collapsible layer comprise discrete raised regions spaced apart along two different directions in the two-dimensional plane of the sheet.

7. The winding core of claim 6, wherein the discrete raised regions are generally dome-shaped.

8. The winding core of claim 1, wherein the atomic regions of the at least one collapsible layer form a pattern that is such that the collapsible layer is readily bendable about the axis in a helical fashion without any significant fiber breakage.

9. A winding core for winding a continuous web of elastically stretchable or shrinkable material to form a roll of the material, wherein the roll has a roll strain energy resulting in a radially inward pressure on the core, the winding core comprising:

a cylindrical structure formed of a plurality of layers wound one upon another about an axis and adhered together, wherein the core comprises:

a radially inner shell formed by a plurality of inner layers each having opposite substantially smooth and non-undulating surfaces; and an energy-absorbing zone disposed radially outwardly of the inner shell, the energy-absorbing zone comprising at least one collapsible layer formed from a sheet that is structured such that each of the opposite surfaces of the sheet defines a three-dimensional structured atomic region that is repeated throughout the surface, the atomic region projecting out of a plane of the sheet and defining a plurality of normal vectors in different sub-regions of the atomic region, wherein the normal vectors, when projected onto the two-dimensional plane of the sheet, are in a plurality of different non-collinear directions in said plane, wherein the atomic regions of each collapsible layer are formed by folded tessellations in the sheet.

10. A winding core for winding a continuous web of elastically stretchable or shrinkable material to form a roll of the material, wherein the roll has a roll strain energy resulting in a radially inward pressure on the core, the winding core comprising:

a cylindrical structure formed of a plurality of paperboard layers wound one upon another about an axis and adhered together, wherein the core comprises:

a radially inner shell formed by a plurality of inner paperboard layers each having opposite substantially smooth and non-undulating surfaces; and an energy-absorbing zone disposed radially outward of the inner shell, the energy-absorbing zone comprising at least one collapsible paperboard layer formed from a sheet that is structured such that each of the opposite surfaces of the sheet defines a three-dimensional structured atomic region that is repeated throughout the surface, the atomic region projecting out of a plane of the sheet and defining a plurality of normal vectors in different sub-regions of the atomic region, wherein the normal vectors, when projected onto the two-dimensional plane of the sheet, are in a plurality of different non-collinear directions in said plane;

wherein the energy-absorbing zone is structured such that collapsing of the energy-absorbing zone begins during or after winding of the web to form the roll, but the energy-absorbing zone still has additional collapsibility at the moment when winding of the roll is just completed, said additional collapsibility being sufficient to substantially absorb continued radially inward pressure exerted by the roll after completion of winding, and wherein the energy-absorbing zone has a strain energy of at least about 20 lb-inches at a load-displacement slope of 44,000 lb/in.

11. A method for making a winding core for winding a continuous web of elastically stretchable or shrinkable material to form a roll of the material, wherein a roll strain energy exists in the roll about the core, resulting in a radially inward pressure on the core, the method comprising the steps of:

forming an inner shell by winding a plurality of inner layers one upon another about an axis and adhering the inner layers together, the inner layers having opposite substantially smooth and non-undulating surfaces; and winding at least one collapsible layer about the inner shell to form an energy-absorbing zone about the inner shell, the at least one collapsible layer being formed from a sheet that is structured such that each of the opposite surfaces of the sheet defines a three-dimensional structured atomic region that is repeated throughout the surface, the atomic region projecting out of a plane of the sheet and defining a plurality of normal vectors in different sub-regions of the atomic region, wherein the normal vectors, when projected onto the two-dimensional plane of the sheet, are in a plurality of different non-collinear directions in said plane, wherein the energy-absorbing zone is substantially completely collapsible under a radially inward pressure of $P_c$, and wherein the inner shell is configured to have a nominal radial crush strength that exceeds $P_c$ by a safety margin of about 10% to about 50%.

12. The method of claim 11, wherein the energy-absorbing zone is configured such that collapsibility of the energy-absorbing zone is substantially uniform over the entire outer surface of the core.

13. The method of claim 11, wherein the energy-absorbing zone is structured such that collapsing of the energy-absorbing zone begins during or after winding of the web to form the roll, but the energy-absorbing zone still has additional collapsibility at the moment when winding of the roll is just completed, said additional collapsibility being sufficient to substantially absorb continued radially inward pressure exerted by the roll after completion of winding.

14. The method of claim 11, wherein the energy-absorbing zone is constructed to have a strain energy of at least about 20 lb-inches at a load-displacement slope of 44,000 lb/in.

* * * * *

UNITED STATES PATENT AND TRADEMARK OFFICE

CERTIFICATE OF CORRECTION

PATENT NO. : 9,212,021 B2
APPLICATION NO. : 12/025441
DATED : December 15, 2015
INVENTOR(S) : Rhodes et al.

It is certified that error appears in the above-identified patent and that said Letters Patent is hereby corrected as shown below:

On the Title page,
Item (75) "Hartsville, CA (US)" should read --Hartsville, SC (US)--.

Signed and Sealed this
Twenty-first Day of June, 2016

Michelle K. Lee

Michelle K. Lee
*Director of the United States Patent and Trademark Office*